US006811616B2

(12) United States Patent
Wack

(10) Patent No.: US 6,811,616 B2
(45) Date of Patent: Nov. 2, 2004

(54) METHOD FOR THE LIQUID CLEANING OF OBJECTS

(75) Inventor: Oskar Wack, Ingolstadt (DE)

(73) Assignee: O. K. Wack (DE)

( * ) Notice: Subject to any disclaimer, the term of this patent is extended or adjusted under 35 U.S.C. 154(b) by 216 days.

(21) Appl. No.: 10/008,633

(22) Filed: Dec. 7, 2001

(65) Prior Publication Data

US 2002/0189644 A1 Dec. 19, 2002

(30) Foreign Application Priority Data

Dec. 7, 2000 (DE) ..... 100 60 891

(51) Int. Cl.[7] ..... B08B 7/04
(52) U.S. Cl. ..... 134/10; 134/34; 134/42
(58) Field of Search ..... 134/2, 10, 19, 134/26, 30, 34, 35, 36, 42

(56) References Cited

U.S. PATENT DOCUMENTS

| | | | | | |
|---|---|---|---|---|---|
| 5,401,414 | A | * | 3/1995 | Wack et al. | 210/651 |
| 5,486,314 | A | * | 1/1996 | Wack et al. | 510/163 |
| 5,610,132 | A | | 3/1997 | Momoda et al. | 510/506 |
| 5,741,368 | A | | 4/1998 | Sahbari | 134/38 |
| 5,876,510 | A | * | 3/1999 | Kuemin et al. | 134/12 |
| 6,569,252 | B1 | * | 5/2003 | Sachdev et al. | 134/2 |
| 2002/0189644 | A1 | * | 12/2002 | Wack | 134/10 |
| 2003/0066540 | A1 | * | 4/2003 | Sachdev et al. | 134/1 |

FOREIGN PATENT DOCUMENTS

| | | | |
|---|---|---|---|
| DE | 4421954 | * | 1/1996 |
| DE | 019609119 A1 | * | 9/1997 |
| DE | 19619269 A1 | * | 11/1997 |
| DE | 19908434 A1 | | 10/2000 |
| EP | 0475596 | * | 3/1992 |
| EP | 0587917 A1 | * | 3/1994 |
| WO | wo9628535 | * | 9/1996 |
| WO | WO 97/32963 | | 9/1997 |
| WO | WO 00/50555 | | 8/2000 |

OTHER PUBLICATIONS

XP–002193568, Database WPI, Section Ch, Week 199530, Derwent Publications Ltd.

* cited by examiner

*Primary Examiner*—Alexander Markoff
(74) *Attorney, Agent, or Firm*—R W Becker & Associates; R W Becker

(57) ABSTRACT

A method for the liquid cleaning of objects via a cleaning liquid that contains at least two components that under first designated conditions form a mixture and under second designated conditions form a solubility gap, contains the following steps:

establishing the first designated conditions, liquid cleaning the objects with the cleaning liquid that is under the first designated conditions, establishing the second designated conditions, and at least partially separating the contaminations from the liquid under the second designated conditions.

16 Claims, 1 Drawing Sheet

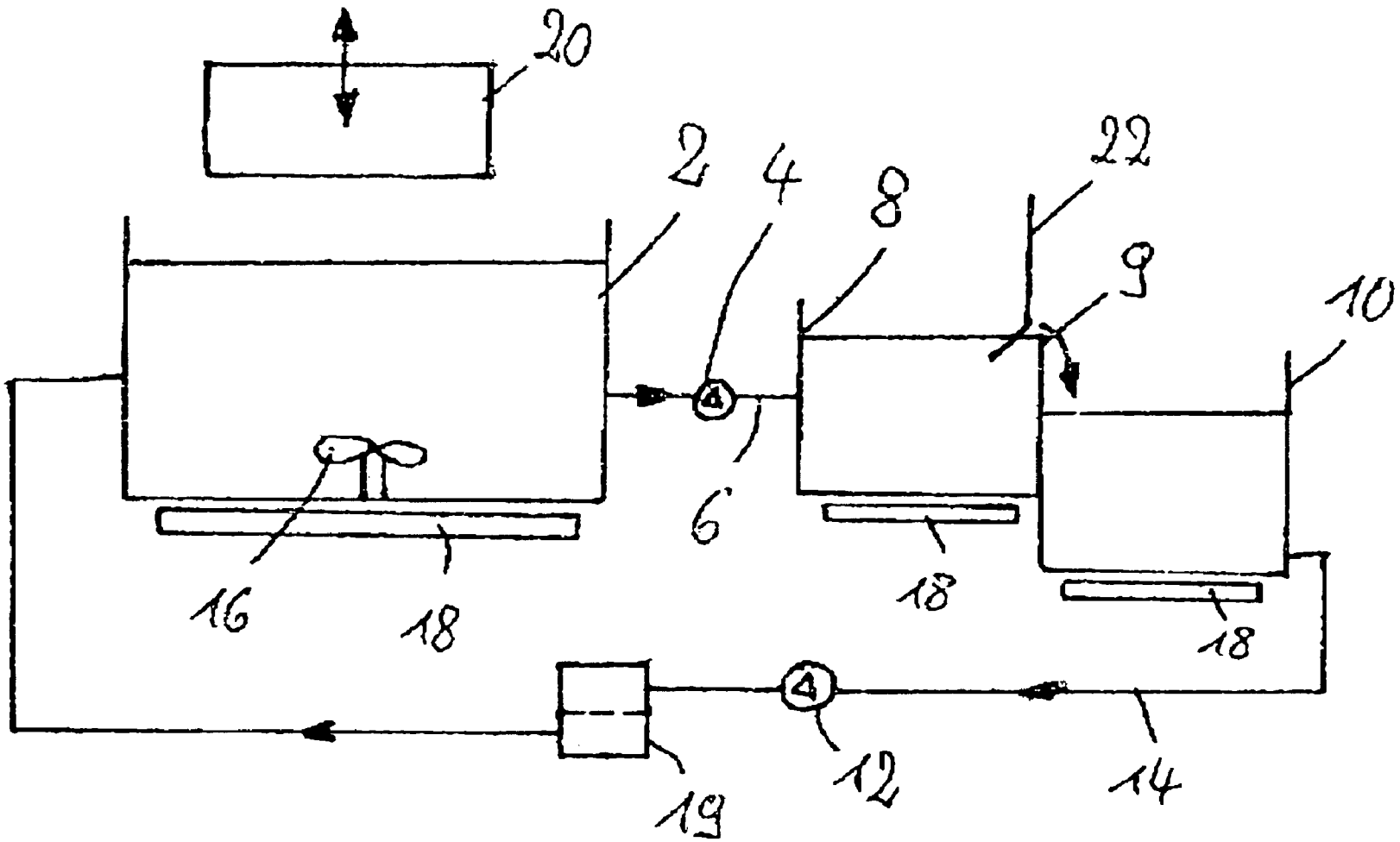
10
22
9
8
4
2
20
18
18
18
14
12
6
19
16

METHOD FOR THE LIQUID CLEANING OF OBJECTS

BACKGROUND OF THE INVENTION

The invention relates to a method for the liquid cleaning of objects.

In practice, cleaning objectives are encountered at very different locations, be it for the liquid cleaning of objects of metal, glass, ceramic, plastic or composite materials, to remove contaminations for the reuse of the objects in a clean state, for example in hospitals or domestic use, be it for the cleaning of objects within manufacturing processes in which the processing technique such as lacquering, soldering, welding, etc., requires clean surfaces, or be it for the cleaning of textiles, just to name a few examples. In this connection, very different contaminations must be removed, for example inorganic dirt such as pigments or dirt containing ionic salts that are easily removed with water, organic dirt in the form of residues from charging, lubrication, lapping and polishing paste, soldering paste, adhesives, etc., as well as various combinations of the types of dirt mentioned by way of example.

For respective types of dirts various solvents are provided that dissolve the respective dirt particularly well, whereby such solvents are not only expensive, but frequently also have a poor compatibility with the environment, so that one must use them as sparingly as possible. DE 199 08 434 A1 discloses a method for the liquid cleaning of objects according to which the objects that are to be cleaned are brought into intense contact with a cleaning liquid that has an organic solvent having good solubility characteristics for the dirt that is to be removed, and is present in the form of an emulsion of the type solvent in water. With such an aqueous emulsion, despite relatively small concentrations of the solvent organic dirt, as well as inorganic dirt due to the water content, can be effectively removed. Removed dirt is to be deposited on the surface of the cleaning liquid from where it is removed, so that the cleaning liquid, i.e. the solvent contained therein, need be only slightly topped off.

The object of the present invention is to provide a method for the liquid cleaning of objects with which excellent cleaning effects are achieved and with which the quantity of required solvent or solvents or organic components is further reduced.

SUMMARY OF THE INVENTION

This object is realized with the features of the main claim.

The invention utilizes the recognition known from the aforementioned DE 199 08 434 A1 that cleaning liquids having at least two components, which are adapted to the respective contamination, clean particularly efficiently if the two components, under certain first conditions, for example under certain pressure and temperature conditions, form a solubility gap in the concentrations that are present.

For the purposes of definition, in the following "mixture" means a system comprising two or more types of molecules, the chemical and physical characteristics of which are spatially constant (homogeneous system). A solution is a mixture with which one material or one type of molecule is present in excess. Two liquids form a solubility gap if they cannot be mixed together without limitation; one then obtains two liquid phases in which the components of the liquid are present in a varying composition, for example, the one component extensively in the one phase and the other component extensively in the other phase. A solubility gap can be observed in that the clear liquid becomes turbid with a change in temperature, i.e. forms an emulsion, that is an indication of the phase separation. However, the turbidity or emulsion is not a necessary indication for a solubility gap; there are so-called micro emulsions in which the two phases are finely distributed such that the liquid continues to be optically clear.

Due to phenomena that up to now are not fully understood, in general a liquid that is composed of two components and is in the state of a solubility gap has a better cleaning capacity than do the two individual components if they are used in a pure state or in a highly concentrated state one after the other. Perhaps the excellent cleaning effect of liquids that are present in a solubility gap is brought about by interaction at the interfaces between the two phases, and possibly additionally by mechanical effects due to the droplets that are frequently held in distinct movement via ultrasound or a stirring mechanism. The use of the liquid in the state of the solubility gap thus enables an advantageous cleaning not only with regard to its cleaning effect but also with regard to the duration and with regard to the quantities of individual components that are required.

So that the cleaning liquid can remain in use as long as possible, it must be freed from the contaminations that it has received. Pursuant to the invention, this takes place in that the cleaning liquid is brought out of the state of the solubility gap into the state of a true mixture, i.e. a homogeneous state. From this homogeneous liquid the contaminations can be removed, depending on the nature thereof, via a filter (especially inorganic pigment-containing contaminations), or in that the contaminations, as a consequence of their densities that are different from the liquid, accumulate at the base or on the surface of the liquid, from where they are withdrawn (especially fatty contaminations). If a filtration or a separation of the liquid is, in contrast, to be effected in the state of the solubility gap, in so doing also a large percentage of at least that component is separated off that ties up or captures a respective contamination or binds it to its contact surface.

On the whole, as a result of the planned conversion of the cleaning liquid on the one hand into the state of the solubility gap for the cleaning, and on the other hand into the state of the true mixture for the separation of the contaminations, an efficient method is provided for the liquid cleaning of objects, which method, with an extensive ability to recycle the cleaning liquid (separation of contaminations), enables an effective cleaning of very different types of objects. It is to be understood that the composition of the cleaning liquid is adapted to the respective cleaning problem, whereby it is merely mandatory to select such components that under first designated conditions form a solubility gap, and under second designated conditions mix with one another.

In another aspect of the present teachings, the cleaning liquid preferably comprises water and an organic component, which provides the advantage that not only inorganic but also organic dirt can be dissolved, whereby the organic component can frequently be present in a relatively low concentration and yet deans as if it were present in a higher concentration.

A very good cleaning effect for a wide variety of types of contamination is achieved when the organic components include molecules having lipophilic and hydrophilic groups that can form a solubility gap with water.

In another aspect, the cleaning liquid is preferably in the state of a two-phase system under the second designated conditions, in which organic-rich droplets are dispersed in a continuous aqueous phase. In this case, a cleaning method is provided according to which the cleaning liquid comprises predominantly water.

The present methods can be carried out in a particularly straightforward manner if the state of the solubility gap changes to the state of the homogeneous mixture by merely altering the temperature. Other possibilities for converting the two states into one another comprise a change in pressure, a particularly intensive agitation, e.g. by means of ultrasound, by introduced contaminations that lead to a shifting of an equilibrium or to an unstable state suddenly changing over into a stable one, etc.

It is particularly advantageous if the first designated condition includes a temperature that is higher than the temperature of the second designated condition, since the cleaning effect is generally better at a higher temperature than at a lower temperature.

In another aspect, the homogenous mixture subjected to the second designated conditions is preferably filtered, which is particularly effective for separating contaminants from the cleaning liquid.

The present methods are particularly suitable for all liquid cleanings where no chemical reaction takes place between the contaminants and the cleaning liquid, which chemical reaction changes the molecular composition of the cleaning liquid. The cleaning liquid in the state of the solubility gap (two-phase solution) is a medium with which contaminations are effectively transferred from the uncleaned surface of an object to be cleaned into the cleaning liquid. The conversion of the cleaning liquid from the state of the solubility gap into the state of the homogeneous mixture is the key for being able to effectively remove the contaminations contained in the cleaning liquid from the cleaning liquid.

BRIEF DESCRIPTION OF THE DRAWINGS

The invention will subsequently be explained with the aid of one example and the accompanying single figure, which illustrates an apparatus for carrying out the inventive method.

DESCRIPTION OF PREFERRED EMBODIMENTS

In the illustrated example, electronic components are to be cleaned of contaminations that influence the resistance between contacts and/or that make the components susceptible to moisture, since they are, for example, hygroscopic. Such contaminations are, for example, residues of SMD adhesives (SMD=Surface Mounted Device), residues of soldering paste, flux residues, etc. The cleaning liquid, that is advantageously used to clean such residues, contains water and an organic component in relative quantities of (100-x) wt.-%: x wt.-%, where x is in the range of $0 \leqq 35$, preferably in the range of $3 \leqq x \leqq 25$, especially preferably in the range of $4 \leqq x \leqq 15$. The organic component preferably contains molecules having hydrophilic and lipophilic groups of the general formula $R^1—[X]_n—R^3$, whereby $R^1$ and $R^3$, respectively independent of one another, stand for Saturated straight chain $C_1$–$C_8$ and branched $C_3$-C18-alkyl groups Unsaturated straight chain $C_3$–$C_{18}$-chains Unsaturated branched $C_4$–$C_{18}$-chains Saturated cyclical $C_3$–$C_{18}$-groups Unsaturated cyclical $C_5$–$C_{18}$-groups; and X stands for straight chained and branched alkyl groups having up to 18 C atoms In the described example, the cleaning liquid contains 90 wt.-% water and 10 wt.-% glycol ether, preferably dipropylene glycol mono-n-propyl ether.

The designated cleaning liquid is contained in a cleaning tank 2, from which a line 6, which is provided with a pump 4 for controlling the flow velocity, leads into a separation tank 8. The separation tank 8 is connected via an overflow 9 with a collection tank 10, from which a return line 14, which is provided with a pump 12, leads through a filter device 16 back to the cleaning tank 2. Contained in the cleaning tank 2 is an agitation device 19, for example a stirring mechanism and/or an ultrasound device. Each of the tanks 2, 8 and 10 is provided with its own tempering or temperature control device 18 by means of which the temperature of the tanks can be held at a predetermined value independently of one another. Disposed over the cleaning tank 2 is a transport mechanism 20 for receiving the objects that are to be cleaned.

The function of the described apparatus, which on the whole operates at atmospheric pressure, is as follows:

The previously described cleaning liquid is optically clear at room temperature, i.e. the organic component forms a true mixture with the water. If the cleaning liquid is heated to 40°, a turbidity occurs, which indicates that the solubility of the organic component in the water is exceeded and a two-phase system forms, with organic-rich droplets in a continuous aqueous phase. The cleaning tank 2 is held at a temperature of 40°, and the cleaning liquid disposed therein is intensely swirled with the agitation device 16. The transport mechanism 20 is lowered into the cleaning tank 2, so that the objects that are to be cleaned come into intensive contact with the cleaning liquid, which is in the state of the solubility gap. In so doing, the cleaning liquid is continuously pumped off into the separation tank 8 via the pump 4, with the separation tank being held at a temperature of only 20°, so that the contaminated cleaning liquid is present at that location in the state of the true mixture. Organic dirt, which is specifically lighter than the liquid, is deposited on the surface and can be removed with a rake 22 or some other device. Specifically heavier dirt is deposited at the base of the separation tank 8, where it can be withdrawn via a non-illustrated known device.

From the separation tank 8, in which the cleaning liquid, which is present in the state of the true mixture, has a minimal movement, the cleaning liquid is transferred via the overflow 9 into the collection tank 10, which is also held at 20°, so that the cleaning liquid remains in the state of the mixture. From the collection tank 10, the cleaning liquid is pumped off via the pump 12 and flows through a filter device 19 in which the inorganic and/or particulate dirt is removed by filtration. The cleaning liquid that is cleaned of contamination in this manner passes back into the cleaning tank 2, where it again comes into contact with the objects that are to be cleaned. The cleaning process continues until the objects are freed of all contaminations, whereupon the transport mechanism 20 is removed from the cleaning tank 2.

It is to be understood that the described apparatus can be modified in many ways. For example, the transport mechanism 20 can subsequently also be moved into a rinsing container having hot water and/or into a drying tank. Furthermore, the cleaning liquid does not necessarily have to be continuously pumped or circulated, rather, the removal of the contaminations taken up by the liquid can occur in a batch-wise manner.

As is clear from the preceding, the cleaning liquid serves as a transport medium for the contaminations by removing and receiving these contaminations from the objects in the cleaning tank 2, subsequently giving up the contaminations in the separation tank 8 by separation and giving up the contaminations in the filter device by filtration.

The described system can be modified such that for example in a utensil rinsing machine or washing machine in the cleaning tank, the described method occurs, with the cleaning liquid then being pumped out of the cleaning tank into a storage tank where it is stored, while in the cleaning tank only rinsing procedures take place. The cleaning liquid can subsequently be pumped back into the cleaning tank for the cleaning of further objects. In this manner, the cleaning liquid can be used many times for the cleaning of objects, and need only occasionally be topped off. The separated contaminations can be removed with the rinsed water.

Further examples for the basic composition of liquids having a solubility gap, which composition comprises water and an organic component, will be provided in the following. In this connection, in each case first the chemical designation of the organic component is provided, then the concentration up to which the organic component is soluble with water at room temperature, and then the concentration up to which water can be added and be soluble with the organic component. In the first example, glycol ether, the solubility gap at room temperature is thus between 5% and 82% glycol ether in 95% or 18% water respectively. The subsequent information (first example): MPC (Multi Phase Cleaning) at 5% starting at 29° C. indicates respectively the concentration of the organic component with which one advantageously operates with the respective liquid, and the temperature above which a good cleaning effect is achieved due to the stable solubility gap. For the complete mixing or for the separation of the contaminations, the liquid is respectively advantageously cooled off to room temperature. It is to be understood that one advantageously works with concentrations that are slightly, e.g. 0.1 to 0.2%, below the concentration at which the solubility gap occurs at room temperature.

| Glycol Ether: | |
|---|---|
| Propyleneglycolmonobutlyether PnB | |
| Water Solubility | 5% |
| Water in PnB | 18% |
| MPC at 5% starting at 29° C. | |
| Dipropyleneglycolmono n-butylether DPnB | |
| Water Solubility | 4% |
| Water in DPnB | 14% |
| MPC at 1% starting at 23° C. | |
| Tripropyleneglycolmono n-butylether TPnB | |
| Water Solubility | 3% |
| Water in TPnB | 8% |
| MPC at 3% starting at 23° C. | |
| Tripropyleneglycolmonopropylether TPnP | |
| Water Solubility | 5% |
| Water in TPnP | 12% |
| MPC at 5% starting at 45° C. | |
| Propyleneglycolphenylether PPH | |
| Water Solubility | 1% |
| Water in PPH | 6% |

-continued

| | |
|---|---|
| MPC at 1% starting at 23° C. | |
| Ester/Acetate | |
| Propyleneglycoldiacetate PGDA | |
| Water Solubility | 8% |
| Water in PGDA | 4% |
| MPC at 8% starting at 23° C. | |
| Dipropyleneglycolmonoethyletheracetate DPMA | |
| Water Solubility | 5% |
| Water in DPMA | 8% |
| MPC at 5% starting at 42° C. | |
| Butylglycolacetate | |
| Water Solubility | 1.5% |
| Water in Butylglycolacetate | 5% |
| MPC at 1.5% starting at 30° C. | |
| Butyldiglycolacetate | |
| Water Solubility | 6.5% |
| Water in Butyldiglycolacetate | 10% |
| MPC at 6.5% starting at 35° C. | |
| Alcohols | |
| Cyclohexanol | |
| Water Solubility | 3.7% |
| Water in Cyclohexanol | 7% |
| MPC at 3.7% starting at 35° C. | |
| Hexylalcohol | |
| Water Solubility | 0.6% |
| Water in Hexylalcohol | 0% |
| MPC at 10% starting at 35° C. | |
| -2-Ethyl-1-hexanol | |
| Water Solubility | 0.1% |
| Water in 2-Ethyl-1-hexanol | 0% |
| MPC at 0.1% starting at 22° C. | |

The specification incorporates by reference the disclosure of German priority document 100 60 891.4 filed 07 Dec. 2000.

The present invention is, of course, in no way restricted to the specific disclosure of the specification, drawings and examples, but also encompasses any modifications within the scope of the appended claims.

What is claimed is:

1. A method comprising:

contacting an object with a cleaning liquid while the cleaning liquid is in the state of a two-phase solution, thereby removing contaminants from the object, the cleaning liquid comprising water and an organic component in amounts that are: (i) not fully miscible at a first temperature, in which the two-phase solution is formed, and (ii) fully miscible at a second temperature, in which a homogeneous, one-phase solution is formed, the first temperature being higher than the second temperature, and removing contaminants from the cleaning liquid while the cleaning liquid is in the state of the homogeneous, one-phase solution.

2. A method as in claim 1, wherein the organic component comprises lipophilic and hydrophilic groups.

3. A method as in claim 1, wherein the two-phase solution comprises organic-rich droplets dispersed in a continuous aqueous phase.

4. A method as in claim 1, wherein the step of removing contaminants from the cleaning liquid comprises filtering the cleaning liquid.

5. A method as in claim 1, wherein the organic component comprises less than about 35% of the cleaning liquid.

6. A method as in claim 1, wherein the organic component comprises between about 3–28% of the cleaning liquid.

7. A method as in claim 1, wherein the organic component comprises a glycol ether.

8. A method as in claim 1, wherein the organic component comprises lipophilic and hydrophilic groups, the two-phase solution comprises organic-rich droplets dispersed in a continuous aqueous phase and the organic component comprises less than about 35% of the cleaning liquid.

9. A method as in claim 8, wherein the step of removing contaminants from the cleaning liquid comprises filtering the cleaning liquid.

10. A method as in claim 9, wherein the organic component comprises a glycol ether.

11. A method comprising:

subjecting a cleaning liquid to a first set of conditions, wherein the cleaning liquid is brought into a state of a two-phase emulsion, the cleaning liquid comprising water and an organic component having lipophilic and hydrophilic groups, the amounts of the water and the organic component being selected so that the cleaning liquid forms: (i) the two-phase emulsion under the first Set of conditions and (ii) a homogeneous, one-phase solution under a second set of conditions, the first and second sets of conditions including temperature and the temperature of the first set of conditions is higher than the temperature of the second set of conditions, contacting an object with the two-phase emulsion, thereby removing contaminants from the object while the cleaning liquid is in the state of the two-phase emulsion, wherein the object is selected from the group consisting of metals, glasses, ceramics, plastics, electric components and combinations thereof, subjecting the cleaning liquid to the second set of conditions, wherein the cleaning liquid is brought into the state of the homogeneous, one-phase solution, and removing the contaminants, which were removed from the object during the applying/cleaning step, from the cleaning liquid while the cleaning liquid is in the state of the homogenous, one-phase solution.

12. A method as in claim 11, wherein the two-phase emulsion comprises organic-rich droplets dispersed in a continuous aqueous phase.

13. A method as in claim 11, wherein the organic component comprises less than about 35% of the cleaning liquid.

14. A method as in claim 11, wherein the organic component comprises between about 3–25% of the cleaning liquid.

15. A method as in claim 11, wherein the step of removing contaminants from the cleaning liquid comprises filtering the cleaning liquid.

16. A method as in claim 11, wherein the organic component comprises a glycol ether.

* * * * *